US005870423A

United States Patent [19]

Gustavsson

[11] Patent Number: 5,870,423

[45] Date of Patent: Feb. 9, 1999

[54] INDIVIDUAL HEATING ELEMENT POWER CONTROL FOR A FURNACE

[75] Inventor: Frank Gustavsson, Hägersten, Sweden

[73] Assignee: Sandvik AB, Sandviken, Sweden

[21] Appl. No.: 746,141

[22] Filed: Nov. 6, 1996

[30] Foreign Application Priority Data

Nov. 6, 1995 [SE] Sweden ..... 9503927

[51] Int. Cl.[6] ..... H05B 7/148

[52] U.S. Cl. ..... 373/104; 373/102

[58] Field of Search ..... 373/102, 104, 373/108, 135, 136

[56] References Cited

U.S. PATENT DOCUMENTS

| | | | |
|---|---|---|---|
| 1,506,443 | 8/1924 | Otis . | |
| 1,511,050 | 10/1924 | Collins et al. | 373/136 |
| 2,422,734 | 6/1947 | Jung . | |
| 3,141,918 | 7/1964 | Tanaka . | |
| 3,736,360 | 5/1973 | Bergman et al. . | |
| 4,021,769 | 5/1977 | Edin et al. . | |
| 4,323,763 | 4/1982 | Goldsmith . | |

FOREIGN PATENT DOCUMENTS

| | | |
|---|---|---|
| 0080013 A1 | 6/1983 | European Pat. Off. . |
| 0105770 A1 | 4/1984 | European Pat. Off. . |
| 2348770 B2 | 9/1978 | Germany . |

*Primary Examiner*—Tu Ba Hoang
*Attorney, Agent, or Firm*—Burns, Doane, Swecker & Mathis, L.L.P.

[57] ABSTRACT

During a heating process in a three-phase, electric furnace, power can be controlled by dividing the heating process into intervals and then controlling the average power generated during each of these intervals, and by individually controlling the power generated by each phase. The latter is accomplished without requiring access to a neutral wire.

16 Claims, 2 Drawing Sheets

INDIVIDUAL HEATING ELEMENT POWER CONTROL FOR A FURNACE

BACKGROUND

1. Technical Field

The present invention relates to a three-phase electric furnace comprising heating elements connected to each phase. More particularly, the present invention relates to a method of controlling the heating power generated by the furnace and by each heating element during a heating process. The invention also relates to three-phase electric furnaces which are specifically utilized for sintering cemented carbide blanks.

2. Technical Background and State of the Art

Cemented carbide bodies are produced by powder metallurgical techniques including wet mixing of powders to form the constituents of the bodies; drying the milled mixture to a powder, generally by spray drying; pressing the dried powder into bodies having a desired shape; and sintering.

Sintering is performed in large furnaces which have a total volume of about 2 $m^3$. These furnaces include a furnace cavity which accounts for about 10 percent of the furnace's total volume. The sintering temperature is 1440°–1500° C., and it is very important that the sintering furnace be capable of maintaining a constant temperature between the different zones within the furnace, for example, a zone-to-zone difference that does not exceed ±5° C. This is especially important when producing modern cemented carbide grades which often have highly complex structures.

In prior designs, sintering furnaces employ power supplies which comprise a three-phase transformer. The primary side of the three-phase transformer is connected to a power source via a current regulator, while each of three heating elements is connected to a respective phase on the secondary side of the transformer. The temperature inside the furnace cavity is measured in one place by a temperature sensor which is, in turn, connected to the current regulator. Using the temperature information provided by the temperature sensor, the current regulator corrects the electric current in each phase using phase angle control. The current regulator is capable of making the corrections in parallel. However, sintering furnaces employing this type of temperature control scheme do not and cannot take the zone-to-zone temperature differentials, that exist within the furnace cavity, into consideration.

At extremely high temperatures, graphite rods are used as heating elements. Graphite rods require a supply voltage that is lower than the voltage of the power source and this is the reason why the transformer is necessary. The graphite rods are connected in such a way that they create a star-connected load without a neutral wire. This means that the furnace only has three lead-throughs into the furnace cavity for the respective phase conductors. When using heating elements that require higher supply voltages (e.g., elements of tungsten), the transformer may be omitted.

From one zone to another zone within the furnace cavity, temperature differentials may arise for several reasons. For example, the amount of cemented carbide blanks may vary at different locations within the furnace; the insulation of the furnace may change during the life of the furnace, resulting in large heat leakages at certain places in the furnace; and the phase voltages driving the respective heating elements may vary. Correcting the problems associated with these temperature differentials can be accomplished by individually controlling the heating elements.

The power generated by a furnace employing star-connected graphite rod heating elements is on the order of 200 kVA; the phase voltage supplied to the graphite rods is on the order of 50 V; and the phase currents through the graphite rods may reach 2.5 to 3.0 kA. The construction and location of the graphite elements in the furnace cavity are well suited for controlling the power within three zones.

Therefore, one object of the invention is to provide a method that individually controls the power generated by each heating element in a three-phase, electric furnace.

Another object of the invention is to provide a simple, cost-effective power control system that can be utilized with existing furnaces and new sintering furnaces (i.e., furnaces without a neural wire).

SUMMARY

In accordance with one aspect of the present invention, the foregoing and other objects are achieved by a method in which the heating procedure is divided into cycles, the cycles are subdivided into periods, and the periods are further subdivided into at least one control interval for each phase, wherein the heat generated by each heating element is controlled by switching the heating element on and off for a predetermined length of time during the corresponding control intervals. Although the predetermined length of time may vary, it is chosen such that the average power (i.e., heat) generated by a given heating element during the relevant period corresponds to a desired heating level. Likewise, the total power level generated by the furnace is controlled by activating the heating elements for a predetermined, though variable number of periods during each cycle, and by choosing the predetermined number of periods such that the average power generated during the cycle corresponds to the total, desired power level. In a preferred embodiment, at least two phases are in a conducting state during any one of the predetermined number of periods.

One advantage of the method described above is that the method can be achieved with readily available components. In addition, the necessary control signals for accomplishing the time division of the heating procedure can he generated in a simple manner using a suitable time reference, such as computerized control units that are presently used for controlling furnaces.

According to a preferred embodiment of the invention, the periods are divided into three control intervals, each having a constant duration. Each of the three control intervals is associated with a different phase. This further simplifies the generation of the control signals.

In accordance with another aspect of the invention, the foregoing and other objects are achieved by a three-phase connected electric furnace comprising a heating element connected to each phase. The heat power level in the furnace during a heating process is adjusted by individually controlling the current to each of the heating elements. A characteristic feature of the furnace is that each phase comprises a switch that turns the phase current on and turns the phase current off. This, in turn, controls the heating power generated by each heating element. The invention also comprises a control unit for implementing the aforementioned method.

According to a preferred embodiment, the current switches are connected to the secondary side of a transformer, which is utilized for supplying power to a sintering furnace. This embodiment is advantageous because sintering furnaces whose power supplies include transformers can be modified so as to provide zone-to-zone control according to the invention without significant reconstruction and at a low cost. This is so because the power control for the heating elements can be made without access to a neutral wire. The last feature is especially important when the furnace is used as a pressure vessel because another lead-through for a neutral wire would require approval by the appropriate certification authority.

According to another preferred embodiment of the invention the actual current switches are implemented with controlled thyristor devices. By using these devices there is less interference than with the phase-angle controlled current regulators which are currently used.

Other exemplary embodiments of the method and the furnace according to the invention will be evident from the specification and the figures.

BRIEF DESCRIPTION OF THE DRAWINGS

The invention will be explained in detail by the following in connection with a non-limiting embodiment referring to the drawings, where.

Corresponding parts in the different drawings have been given the same explanatory designations.

DETAILED DESCRIPTION

Figure 1:
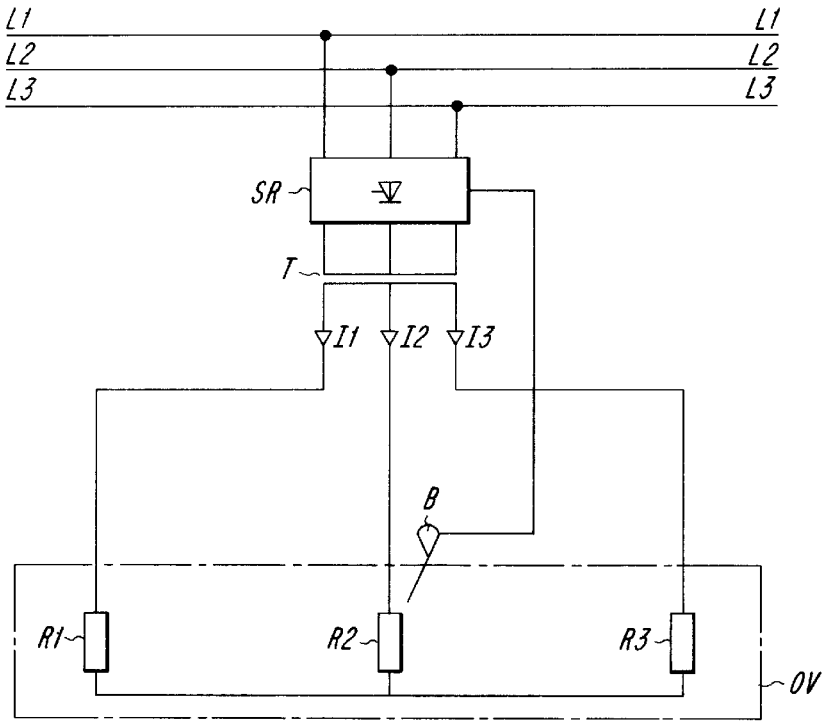
FIG. 1 shows a diagram of a current supply for a sintering furnace according to the state of the art.

The diagram in FIG. 1 shows the configuration of a current supply for a sintering furnace according to the prior art. More particularly, FIG. 1 shows the three-phase conductors L1, L2, L3 associated with the three-phase main power supply, wherein the main voltage is 380 v and the phase voltage is 220 V. The phase conductors L1, L2, L3 are connected to a current regulator SR, which is, in turn, connected to the primary side of a three-phase transformer T. Each of the secondary windings of the three-phase transformer is connected to a respective heating element R1, R2, R3 in the furnace. The furnace cavity OV is shown by a dash-line, thus implying that the heating elements R1, R2, R3 are distributed within the furnace cavity OV. This also implies that the heating elements R1, R2, R3 primarily heat different zones within the furnace cavity OV.

The heating elements R1, R2, R3 in FIG. 1 are made from graphite rods which are connected in such a way that they form a star-connected, substantially symmetric, three-phase load. The furnace has three lead-throughs for the respective phase conductors.

A temperature sensor B is centrally arranged inside the furnace cavity OV, and it provides temperature information to the current regulator SR. The current regulator SR then controls the three phase currents I1, I2, I3 in parallel, based on the temperature information provided by the temperature sensor B. While this design can be used to adjust the total power generated by the furnace, the temperature differentials between the different zones in the furnace cavity OV are not taken into consideration, nor can this design individually adjust the power levels within each zone to compensate for these temperature differentials.

Figure 2:
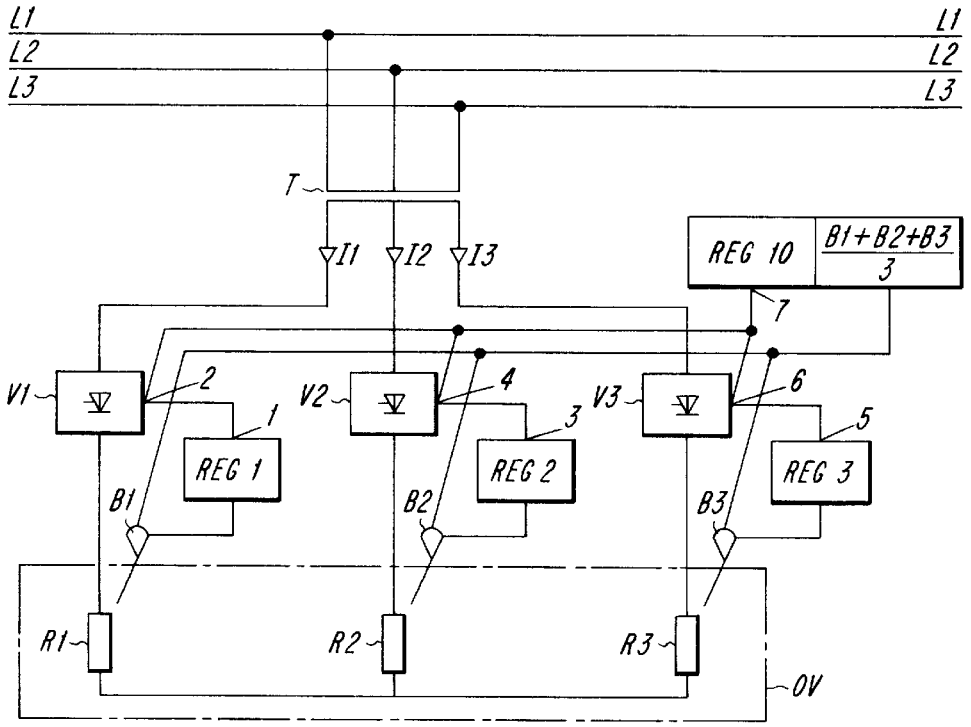
FIG. 2 shows a diagram of the current supply for a sintering furnace according to the present invention.

In the diagram in FIG. 2, the three phases L1, L2, L3 are directly connected to the primary side of the transformer T. The three-phase conductors on the secondary side of the transformer are, via the current switching devices V1, V2, V3, connected to respective heating elements R1, R2, R3, wherein R1, R2, R3 are arranged in the furnace cavity OV in a similar manner as in FIG. 1.

The current switching devices V1, V2, V3 comprise so-called zero transition controlled thyristor devices, which individually switch on or switch off the respective phase currents I1, I2, I3 at a transition zero depending upon the control signals supplied by regulators REG1, REG2, REG3 respectively.

Associated with heating element R1, there is a temperature sensor B1 for sensing the temperature in the corresponding zone of the furnace cavity OV surrounding heating element R1. The temperature sensor B1 is connected to a regulator REG1. Depending on the temperature information supplied by temperature sensor B1, REG1 can generate an on/off control signal at a control signal output 1. The control signal output 1 is, in turn, connected to a control input 2 on the thyristor device V1.

Similarly, heating elements R2, R3 are associated with temperature sensors B2 and B3 respectively. Likewise, temperature sensors B2, B3 are connected to regulators REG2, REG3 respectively, and control signal output 3 and control signal output 5 are connected to control input 4 and control output 6 of the respective thyristor devices V2, V3.

In addition, the present invention includes a main regulator REG10 having a control signal output 7 which is connected to the control inputs 2, 4, 6 of the thyristor devices V1, V2, V3. The main regulator REG10 is furnished with temperature information by all three temperature sensors B1, B2, B3, and the main regulation REG10 generates a control signal on control signal output 7 depending on an average temperature defined by the following relationship:

$$(B1+B2+B3)/3 \quad (1)$$

as indicated in FIG. 2.

Figure 3:
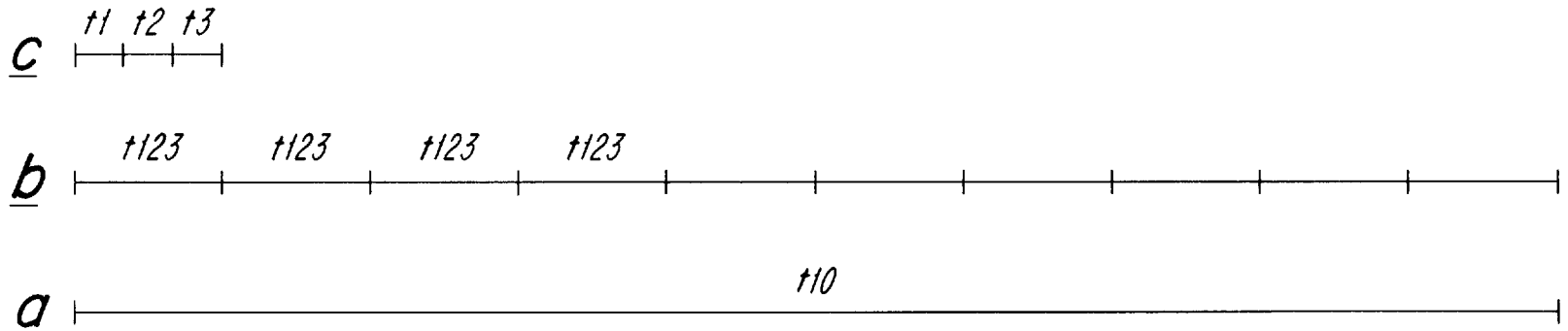
FIG. 3 shows examples of cycles, periods and control intervals used in the control method according to the invention.
Figure 4:
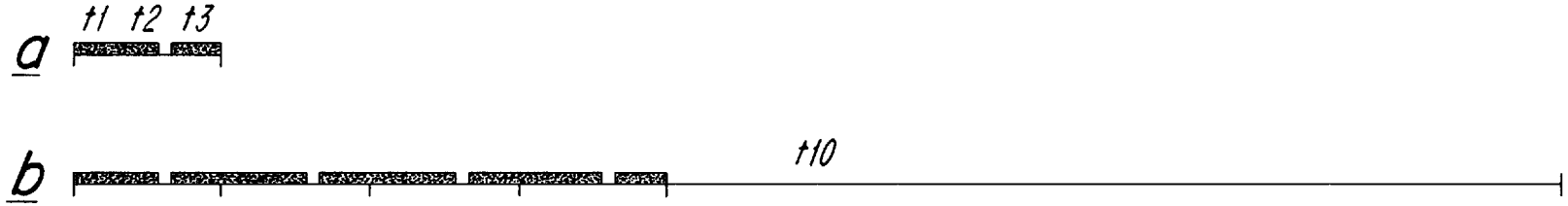
FIG. 4 shows an exemplary power control.

FIG. 2 also illustrates that the present invention is capable of individually controlling the power levels generated by each heating element R1, R2, R3. In addition, the present invention is capable of compensating for the temperature differentials between the different zones within the furnace cavity OV as detected by the temperature sensors B1, B2, B3. Individual control over each of the heating elements R1, R2, R3 is achieved by switching the phase currents I1, I2, I3 on and off at specific times. Switching is accomplished by the thyristor devices V1, V2, V3, and the method for doing so is described in greater detail hereinbelow and is illustrated in FIG. 3 and FIG. 4.

The method, according to a preferred embodiment of the present invention, divides the heating process into cycles. FIG. 3, timeline "a", shows a cycle t10, which is, in turn, divided into ten periods t123 as shown by timeline "b". One skilled in the art, however, will readily understand that ten periods t123 is exemplary and that cycle t10 could be divided into any number of periods without departing from the spirit of the present invention.

Each period t123 is then subdivided into control intervals t1, t2, t3 as shown by timeline "c", wherein each control interval t1, t2, t3 is associated with one of the thyristor devices V1, V2, V3 respectively. Although FIG. 3 shows control intervals t1, t2, t3 as having the same duration, one skilled in the art will also readily understand that each control interval t1, t2, t3 may vary with respect to each other. For example, the duration of each control interval can be changed based on the temperature differentials measured by the temperature sensors B1, B2, B3, such that rapid compensation for large temperature differentials can be achieved.

Control over the power (i.e., heat) generated by each heating element may also be achieved by interrupting each phase current I1, I2, I3 during the corresponding control interval or a specific portion thereof. Interruption of each phase current I1, I2, I3 is accomplished by switching off the respective thyristor device V1, V2, V3. For example, the phase current I1 can be interrupted during the entire control interval t1, or a selected portion thereof, while the other two phases are conducting.

In a similar manner, all three-phase currents I1, I2, I3 can be interrupted for a select number of periods t123, during cycle t10, by the regulator REG10, which generates a control signal for the thyristor devices V1, V2, V3.

By interrupting the respective phase currents I1, I2, I3 during selected portions of the corresponding control intervals t1, t2, t3, a desired average power output for the period is achieved for each heating element R1, R2, R3. Similarly, a desired average total power level is achieved during cycle t10 by interrupting each of the three-phase currents I1, I2, I3 during a select number of periods t123. One skilled in the art will understand that the duration of cycle t10, periods t123 and control intervals t1, t2, t3 are such that the on/off control does not cause any temperature fluctuations.

In a practical application, the control intervals t1, t2, t3 may have a duration of 10 milliseconds (ms), which implies a period t123 duration of 30 ms, wherein each period comprises three control intervals (one for each phase), and a cycle t10 duration of 300 ms, wherein each cycle comprises 10 periods. As the furnace containing cemented carbide blanks has a large thermal mass, thus high thermal inertia, a cycle length of this size does not give rise to measurable temperature fluctuations. It is also possible to increase the length of the cycle t10 by a factor of 10 or more without creating a conflict with the settled temperature limits.

FIG. 4 shows a period t123 comprising control intervals t1, t2, t3, as illustrated by timeline "a". FIG. 4 also shows a cycle t10, as illustrated by timeline "b". In another practical application, the temperature information from temperature sensor B2 indicates that the temperature in the corresponding zone around the heating element R2 is too high, which requires a decrease in power at heating element R2 by 20% during control interval t2. Since control is based on average power, the phase current I2 will be switched off during 20% of control interval t2. This is illustrated in FIG. 4 by the gap appearing towards the end of control interval t2.

At the same time, temperature information from temperature sensors B1, B2, B3 may indicate that a total power consumption of 40% is needed to keep the temperature within the furnace cavity OV at the desired level. Consequently, the main regulator REG10 will switch off all three phase currents I1, I2, I3 for 60% of the time during cycle t10. This is equivalent to six of the ten periods t123.

The 20 percent power reduction in the zone surrounding hearing element R2 and the 60% reduction of total power is graphically illustrated by timeline "b" in FIG. 4. Timeline "b" in FIG. 4 shows four of ten periods t123 with the interval t2 in each of the four periods being reduced by 20%. Timeline "b" should illustrate that the average power during the cycle t10 is also affected by the average power during the periods t123. Therefore, to determine how many periods t123 are needed to achieve the desired average power for the cycle t10, it may be necessary to take the average power output per period t123 into consideration. This may be accomplished in accordance with the following procedure.

The average power P1, P2, P3 for each heating element R1, R2, R3 respectively during a period t123 comprising control intervals t1, t2, t3 is defined by the following relationships.

$$P1=(I1^2*R1*t1+I1^2*R1*t2+I1^2*R1*t3)/t123$$

$$P2=(I2^2*R2*t1+I2^2*R2*t2+I2^2*R2*t3)/t123$$

$$P3=(I3^2*R3*t1+I3^2*R3*t2+I3^2*R3*t3)/t123$$

Accordingly, P1 may be affected by varying the active portion of control interval tl while a full power contribution is provided during control intervals t2 and t3. Average power P2 and P3 may similarly be affected during control intervals t2 and t3 respectively.

By assuming that the load is resistive, symmetric and star-connected, the following calculations can be made. When all three phases are conducting the voltage drop over each heating element R1, R2, R3 is equal to the phase voltage $V_f$. The power generated in each element is then $V_f^2/R$, which is also equal to the maximum power generation Pmax.

When a phase current is switched off the voltage drop over its element R is zero, and consequently, so is the power generation. For the remaining two heating elements the voltage drop becomes equal to half the main voltage, i.e., $V_h/^2$, at which $V_h=V_f\sqrt{3}$. The power generated in each of these two elements is shown by the following relationship:

$$(V_f\sqrt{3}/2)^2/R = 0.75*P_{max}$$

Therefore, the heating element, in the interrupted phase, will have no effect on power, and the heating elements in the other two phases will each contribute 75% of maximum power.

If the length of control intervals t1, t2, t3 are the same, and heating element R1 is switched off during the entire control interval t1, and heating elements R2, R3 are switched on during the entire corresponding control interval, one obtains an average power $2P_{max}/3$ for R1, and an average power $(2P_{max}+0.75*P_{max})/3=2,75*P_{max}/3$ for R2 and R3. Thus, during the period t123, the average power for R1 is about 27% lower than that for R2, R3. By varying the durations of t1, t2, t3 different average power may be achieved.

In FIG. 1 and FIG. 2, the regulators are shown as separate blocks; however, this does not mean that the regulators are physically separate units in practice. Since furnaces today typically utilize computerized control equipment, the regulators are preferably implemented as computer software.

The present invention has been described with reference to a preferred embodiment. However, it will be readily apparent to those skilled in the art that it is possible to embody the invention in other specific forms without departing from the spirit of the invention. The preferred embodiment is merely illustrative and should not be considered restrictive in any way. The scope of the invention is given by the appended claims, rather than the preceding description, and all variations and equivalents which fall within the range of the claims are intended to be embraced therein.

What is claimed is:

1. In a three-phase, electric furnace that includes a heating element connected to each phase, a method for individually controlling the power of a heating element, during a heating process, said method comprising the steps of:

dividing the heating process into a plurality of cycles, dividing each of said plurality of cycles into at least two periods, and dividing each of said at least two periods into control intervals, wherein each of said at least two periods comprises at least one control interval for each phase;

individually activating a heating element independent of other heating elements, using a corresponding phase current, during a predetermined portion of the corresponding control interval, wherein said predetermined portion is chosen so that the average power generated by the heating element during the period corresponds to a desired heating power for that heating element, wherein the two remaining heating elements remain in a conductive state during their corresponding control intervals; and activating each of the heating elements, if at all, during a predetermined number of periods of a given cycle such that the average power generated by the furnace during the given cycle corresponds to a desired, total power level.

2. A method in accordance with claim 1, wherein each of the at least two periods is divided into three control intervals, wherein each control interval has a constant duration and wherein each of the three phases is associated with one of said three control intervals.

3. A method in accordance with claim 1, wherein each of the at least two periods is divided into an optional number of control intervals, and wherein each of the optional number of control intervals has a variable duration.

4. A method in accordance with claim 3 further comprising the steps of:

dividing the furnace into zones, wherein each zone is associated with a heating element and a temperature sensor, and wherein the temperature sensor measures the temperature within the corresponding zone;

switching the heating element on and off during the corresponding control interval, as a function of the temperature in the corresponding zone as measured by the corresponding temperature sensor; and controlling the desired, total power generated by the furnace as a function of the temperature in each zone as measured by the corresponding temperature sensors.

5. A three-phase electric furnace including a heating element connected to each phase, wherein said furnace is capable of individually adjusting heating power levels of each heating element independent of the other heating elements during a heating process by controlling the phase current flowing to each of the heating elements, said furnace comprising:

a current switching device associated with each phase, wherein each current switching device individually controls the heating power level generated by the corresponding heating element, independent of other heating elements, by switching on and switching off the phase current feeding the corresponding heating element;

control means for dividing the heating process into cycles, the cycles into at least two periods, and the at least two periods into control intervals, wherein each period comprises at least one control interval for each phase;

means for generating an on/off control signal, wherein each of said current switching devices is operationally responsive to a corresponding on/off control signal, wherein each on/off control signal causes the phase current, which feeds a corresponding heating element, to switch on and switch off independent of the other heating elements, during select periods, if at all, so that the corresponding heating element generates a desired average heating power level during the corresponding period, and wherein the desired average heating power level generated by each heating element, when combined, corresponds to a desired, total heating power level generated by the furnace during the cycle.

6. A furnace in accordance with claim 5, further comprising:

a voltage supply comprising a three-phase transformer, wherein the primary side of said transformer is connected to a three-phase, main power supply, wherein each phase of the secondary side of the transformer is connected to a current switching device, and wherein said three-phase transformer is utilized as a step-down transformer for reducing the voltage supplied by the main power supply.

7. A furnace in accordance with claim 6, wherein said current switching devices are zero-transition controlled thyristors.

8. A furnace in accordance with claim 6, wherein said heating elements are located within corresponding zones in the furnace, said furnace further comprising:

a temperature sensor located in each zone for measuring the temperature within the corresponding zone, wherein said control means comprises a regulator connected to each phase, said regulator having an input for receiving temperature information from the corresponding temperature sensor and an on/off control signal output connected to the corresponding current switching device, and wherein said regulator commands the corresponding current switching device to switch on and switch off the phase current feeding the corresponding heating element as a function of temperature as measured within the corresponding zone.

9. A furnace in accordance with claim 8, wherein said current switching devices are zero-transition controlled thyristors.

10. A furnace in accordance with claim 8, wherein said control means further comprises:

a main regulator comprising a control signal output connected to each of the current switching devices and a temperature input for receiving temperature information from the temperature sensors in each of said zones, wherein said main regulator controls total heating power level during a given cycle by generating a control signal for the current switching devices based on average zone temperature.

11. A furnace in accordance with claim 10, wherein said current switching devices are zero-transition controlled thyristors.

12. In a furnace for sintering cemented carbide blanks, an apparatus comprising:

a furnace cavity surrounded by an isolation and pressure resistant casing, wherein said furnace cavity has feedthroughs for a three-phase conductor;

heating elements consisting of graphite rods arranged in such a way that they form a symmetric load, wherein each heating element is connected to one of the three phases of the three-phase conductor; and means for controlling furnace power using individual phase currents during a heating process wherein said means for controlling furnace power comprises:

means for dividing the heating process into a plurality of cycles, means for dividing each of said plurality of cycles into at least two periods, and means for dividing each of said at least two periods into control intervals, wherein each of said at least two periods comprises at least one control interval for each phase;

means for individually activating a heating element, independent of other heating elements, using a corresponding phase current, during a predetermined portion of the corresponding control interval, wherein said predetermined portion is chosen so that the average power generated by the heating element during the period corresponds to a desired heating power for that heating element, wherein the two remaining heating elements remain in a conductive state during their corresponding control intervals; and means for activating the heating elements, if at all, during a predetermined number of periods of a given cycle such that the average power generated by the furnace during the cycle corresponds to a desired, total power level.

13. A method in accordance with claim 1 further comprising the steps of:

dividing the furnace into zones, wherein each zone is associated with a heating element and a temperature sensor, and wherein the temperature sensor measures the temperature within the corresponding zone;

switching the heating element on and off during the corresponding control interval, as a function of the temperature in the corresponding zone as measured by the corresponding temperature sensor; and controlling the desired, total power generated by the furnace as a function of the temperature in each zone as measured by the corresponding temperature sensors.

14. A method in accordance with claim 2 further comprising the steps of:

dividing the furnace into zones, wherein each zone is associated with a heating element and a temperature sensor, and wherein the temperature sensor measures the temperature within the corresponding zone;

switching the heating element on and off during the corresponding control interval, as a function of the temperature in the corresponding zone as measured by the corresponding temperature sensor; and controlling the desired, total power generated by the furnace as a function of the temperature in each zone as measured by the corresponding temperature sensors.

15. A furnace in accordance with claim 5, wherein said current switching devices are zero-transition controlled thyristors.

16. A furnace in accordance with claim 5, wherein said heating elements are located within corresponding zones in the furnace, said furnace further comprising:

a temperature sensor located in each zone for measuring the temperature within the corresponding zone, wherein said control means comprises a regulator connected to each phase, said regulator having an input for receiving temperature information from the corresponding temperature sensor and an on/off control signal output connected to the corresponding current switching device, and wherein said regulator commands the corresponding current switching device to switch on and switch off the phase current feeding the corresponding heating element as a function of temperature as measured within the corresponding zone.

* * * * *